US006672492B1

(12) United States Patent
Thompson

(10) Patent No.: US 6,672,492 B1
(45) Date of Patent: Jan. 6, 2004

(54) RIFLE SLING

(76) Inventor: Stephen T. Thompson, 23167 163rd Ave., Cold Spring, MN (US) 56320

( * ) Notice: Subject to any disclaimer, the term of this patent is extended or adjusted under 35 U.S.C. 154(b) by 0 days.

(21) Appl. No.: 10/178,921

(22) Filed: Jun. 24, 2002

(51) Int. Cl.[7] ..... F41C 23/02
(52) U.S. Cl. ..... 224/150; 224/269; 224/913
(58) Field of Search ..... 224/150, 608, 224/661, 269, 913

(56) References Cited

U.S. PATENT DOCUMENTS

| | | | | | |
|---|---|---|---|---|---|
| 919,301 | A | * | 4/1909 | Anderson | 224/149 |
| 1,446,058 | A | * | 2/1923 | Neilly | 224/150 |
| 2,820,498 | A | * | 1/1958 | Endee | 224/608 |
| 3,098,591 | A | | 7/1963 | Lerude | |
| 3,655,106 | A | * | 4/1972 | Wojcinski | 224/150 |
| 3,998,367 | A | * | 12/1976 | Harding | 224/625 |
| 4,331,271 | A | | 5/1982 | Anderson | |
| 4,613,067 | A | * | 9/1986 | Gann | 224/150 |
| 5,325,618 | A | * | 7/1994 | Turner | 42/85 |
| 5,353,538 | A | | 10/1994 | Hakedal et al. | |
| 5,715,979 | A | | 2/1998 | Crandall | |
| 5,738,256 | A | | 4/1998 | Goff et al. | |
| 5,810,219 | A | | 9/1998 | Rosenfield | |
| 5,988,466 | A | | 11/1999 | Brown | |
| 6,112,448 | A | | 9/2000 | Gray et al. | |
| 6,119,907 | A | | 9/2000 | Benjamin | |
| RE37,111 | E | | 3/2001 | Barron | |
| 6,260,748 | B1 | | 7/2001 | Lindsey | |
| 6,279,795 | B1 | | 8/2001 | Pierzina | |

OTHER PUBLICATIONS

Cooper, Jeff, *The Art of the Rifle*, Copyright 1997, pp. 34, 36, 40–45, 48–49, 62–69, Paladin Press, Boulder, CO.

* cited by examiner

*Primary Examiner*—Stephen K. Cronin
(74) *Attorney, Agent, or Firm*—Moore, Hansen & Sumner

(57) ABSTRACT

A rifle sling for transporting a rifle and steadying the rifle during firing is herein disclosed. The sling comprises a strap that is attached at one end near the muzzle of the rifle and at a second end near the butt of the rifle. An intermediate portion of the strap passes freely through a sling clip that is coupled to the truncal region of the bearer of the rifle. When the rifle is placed in its firing position, muzzle flip caused by recoil in the rifle will be resisted by the strap of the sling. The sling clip may clamp the strap of the sling to more securely couple the muzzle end of the rifle to the truncal region of the bearer. In addition, the sling is constructed and arranged to permit the movement of the rifle between its slung and firing positions without uncoupling the strap of the sling from the sling clip.

17 Claims, 2 Drawing Sheets

RIFLE SLING

FIELD OF THE INVENTION

The present invention relates to a sling for stabilizing weapons and other hand-held equipment during use and for transporting the same. More specifically, the present invention relates to a sling that couples the weapon or equipment to the hips and truncal portions of a bearer's body to effect the stabilization of the weapon or equipment.

BACKGROUND OF THE INVENTION

Slings and straps and the like are commonly used for transporting and stabilizing weapons and other hand-held equipment such as rifles, shotguns, handguns, bows, crossbows, binoculars, telescopes, and still and motion picture cameras. As used herein, the term weapon shall be construed broadly to include rifles, shotguns, handguns, bows, crossbows and other weapons as well as hand-held equipment such as binoculars, telescopes, cameras and the like.

One problem common to slings designed to facilitate the transportation of weapons is that there is little thought given to whether or how these slings may be used to stabilize the weapon during firing. One example is U.S. Pat. No. 3,098,591 to Lerude. Lerude's harness is adapted for carrying a rifle in a slung position but teaches nothing with regard to the stabilization of the weapon during firing. U.S. Pat. No. 4,613,067 to Gann discloses a carrying sling that permits a weapon to be transported in a variety of positions but discloses no manner in which the carrying sling may be used to stabilize the gun during firing.

Other slings attempt to navigate the middle ground between ease of transportation and stabilization of the weapon for firing. Examples of such patents include U.S. Pat. No. 4,331,271 to Anderson and U.S. Pat. No. 6,260,748 to Lindsey. Anderson discloses a sling for shoulder guns in which a shoulder gun is supported in a slung position from a belt to which is attached a strap. Pains are taken to insure that the shoulder gun will maintain its slung position during transport. However, for stabilization, Anderson relies on the well-known technique of wrapping the sling strap about the elbow of the arm with which the bearer of the weapon grasps the forearm of the stock. In this way, the bearer of the weapon is able to achieve a more secure connection between his or her arm and the weapon. However, this method of stabilizing a weapon for firing relies on the stability of the bearer's arms, an inherently unstable member of the human body. Accordingly, the Anderson sling is not capable of providing much in the way of stabilization for a weapon being fired.

The Lindsey sling is adapted for supporting a weapon across the front of the bearer's chest. A strap may be included between the muzzle end of the weapon and the shoulder of the bearer and by tensioning this strap between the shoulder and the muzzle end of the weapon the weapon may be stabilized to some degree. Not only is Lindsey's sling relatively limited insofar as it offers only two carrying positions for the weapon, but it provides no dissipation of the phenomenon of muzzle flip as the anchoring point for the stabilizing strap is positioned above the muzzle end of the weapon when the weapon is fired.

Other prior art designs have all but abandoned the goal of supporting a weapon for transport in favor of providing a maximum amount of stability for the weapon during firing. U.S. Pat. No. 5,738,256 to Goff et al. discloses an adaptable aiming support which essentially comprises a belt that has a rigid support with a fork at its upper end attached thereto. In use, the fork at the end of the rigid support is placed beneath the forearm or muzzle end of the weapon being fired when the weapon is in its firing position. The Goff et al. aiming support does offer better stability to the weapon during firing but is incapable of use as a traditional sling in that it is not able to support a weapon during transport at all.

U.S. Pat. No. 5,988,466 to Brown is a variation upon the adaptable aiming support of Goff et al. in that the tubular support member upon which a weapon is supported is permanently affixed to the weapon and is constructed and arranged to have a greater degree of rotation, thereby allowing the gun to be moved from a firing position to a carrying position in which the muzzle of the gun points upwardly. However, the weapon remains coupled to the tubular support member and may not be transported apart from the support without first uncoupling the weapon from the support. But in doing so, the weapon will have to be re-coupled to the support for use in the intended manner.

U.S. Pat. No. 6,112,448 to Gray et al. discloses a forearm sling that attempts to improve the stability of a weapon during firing by coupling the weapon to the forearm of the bearer. Again, while coupling a weapon to the arm of a bearer can increase the stability of the weapon during firing to some degree, the arm of a bearer is inherently unstable and cannot adequately stabilize a weapon during firing. What is more, the Gray et al. forearm sling has no way of counteracting the incidence of muzzle flip engendered by the firing of the weapon and does not provide a means for transporting the weapon.

Accordingly, there is a recognized need for a sling for use with weapons of various types and with other types of hand-held equipment that can facilitate the transport of the weapon in a variety of slung positions, in the crook of an arm, or in the hands, that does not involve the need to disassemble the sling. There is also a need for a sling that can couple a weapon to the hips and the truncal portion of a bearer's body to sufficiently stabilize the weapon for firing. Such a sling must be usable in multiple shooting/use positions.

These and other objectives and advantages of the invention will appear more fully from the following description, made in conjunction with the accompanying drawings wherein like reference characters refer to the same or similar parts throughout the several views.

SUMMARY OF THE INVENTION

The objectives of the present invention are realized in a sling for a typical rifle or shotgun that has a barrel mounted in a stock with a butt end arranged to be positioned against the shoulder of a bearer when the rifle is in a firing position and a forearm portion positioned adjacent a muzzle end of the barrel, with the muzzle end of the rifle being supported at the forearm portion of the stock by the bearer when the rifle is in its firing position. The rifle is steadied in its firing position by a sling that comprises a flexible strap that has a first end and a second end. The first end of the strap is rotatively attached to the rifle adjacent its butt end, the second end of the strap being similarly attached to the rifle at the forearm portion of the stock of the rifle adjacent the muzzle end of the barrel of the rifle. Typically, the strap of the sling is attached to the rifle using standard, well-know devices such as a simple D-ring screwed to the stock of the rifle or a hammerhead sling socket. The strap also has an intermediate portion that is coupled to the waist of the bearer of the rifle.

When the rifle is in its firing position with the butt end of the rifle positioned against the bearer's shoulder, the strap of the sling extends downward to the bearer's waist and from there to the forearm portion of the stock of the rifle, thereby creating a relatively rigid coupling between the waist or torso of the bearer of the rifle. This coupling between the muzzle end of the rifle and the waist of the bearer prevents recoil forces engendered in the rifle as a result of firing the rifle from causing to the muzzle end of the rifle to rise. This rise, called muzzle flip, can negatively affect the aim of the bearer and result in inaccurate and imprecise shooting.

An important aspect of the sling of the present invention is that the strap of the sling is also capable of supporting the rifle in a carrying position in which the rifle is positioned on the back of the bearer for transport.

The strap of the rifle sling of the present invention may be coupled to the waist or torso of the bearer of the rifle in many ways. It must be pointed out that in at least one embodiment of the present invention the sling strap is simply passed through the belt or a belt loop of the bearer. Because the butt end of the rifle stock is firmly anchored to the shoulder area of the torso, the fixed length of the strap effectively couples the muzzle end of the rifle to the waist of the bearer so as to prevent or at least reduce muzzle flip.

In another embodiment, the strap of the rifle sling is coupled to the waist of the user using a simple carabiner type mechanism that is itself coupled to the belt or belt loop of the bearer. Use of the carabiner allows the sling strap to be easily detached from the waist of the bearer. Alternatively, the bearer may couple the sling strap to his or her waist using a more complex harness that attaches to the waist and/or at least one leg of the bearer.

Where desirable, the sling strap may be constrained with respect to the bearer's waist and to the carabiner type structure used to couple the sling strap thereto. A simple way of accomplishing this is to secure a stop to the sling strap so as to control the movement of the sling strap through the carabiner or loop that couples the sling strap to the bearer's waist. The stop creates a relatively rigid connection of predetermined length between the muzzle end of the rifle and the waist of the bearer by limiting the travel of the sling strap through the carabiner or ring coupled to the waist of the bearer. Another, more complex embodiment of the present invention comprises a sling clip that is coupled to the waist of the bearer and which is constructed and arranged to releasably grip the strap of the sling when the rifle is in its firing position. Once the rifle is in its firing position, the sling clip grasps the strap and securely couples the muzzle end of the rifle to the waist of the bearer to prevent or limit muzzle flip.

In general, the sling strap should be substantially non-elastic or have an elasticity that is relatively low. Good examples of suitable materials from which the sling strap may be fashioned include webbing of nylon and other synthetic materials such as Kevlar, polyvinyl chloride, and the like and natural materials such as leather.

The present invention may also be characterized as a rifle sling that comprises a flexible strap having a first end and a second end, with the first end of the strap being secured to the rifle near a muzzle end of the rifle and the second end of the strap being secured near a butt end of the rifle. The strap is also slidably received through a sling clip that is secured to the hips of the bearer of the rifle so that the bearer of the rifle may move the rifle from a slung position to a firing position while the sling strap remains coupled to the hips of the bearer. The sling clip is constructed and arranged such that when the rifle is in its firing position, the strap may be secured to the sling clip to couple the muzzle end of the rifle to the hips of the bearer. This effectively couples the muzzle end of the rifle to the hips of the bearer such that when the rifle is fired, the strap minimizes a rise in the muzzle end of the rifle caused by the recoil of the rifle as it is fired.

An important benefit to the use of the sling of the present invention is that the flexible strap and the sling clip permit the bearer of the rifle to carry the rifle in the port arms position, cradled in the crook of the bearer's right or left arm, cantilevered over the bearer's right or left forearm with the stock of the rifle being wedged under the bearer's respective arm, to be slung over the shoulder of the bearer, to be slung across the bearer's back, and to be carried in the hand of the bearer with the bearer's arm extended, respectively. Similarly, the rifle may be fired from a group of firing positions consisting of a prone position, a sitting position, a squatting position, an offhand position, a standing position, a kneeling position, and a rest position in which the rifle is supported, at least in part, by an object that is not the bearer of the rifle. The rifle may be freely moved between the transport or carrying positions and the firing position with ease and without requiring the sling strap to be uncoupled from the hips of the bearer.

The present invention may further be characterized as a rifle sling for minimizing muzzle flip when a rifle is fired. Such a rifle sling comprises a strap having a first end and a second end and a sling clip that is secured to the hips of the bearer of the rifle. The first end of the strap is connected to the rifle at a muzzle end thereof and the second end of the strap is connected to the rifle at the butt end thereof. An intermediate portion of the strap between the first and second ends of the strap is passed through the sling clip. The sling clip further comprises a clamping mechanism that selectively clamps the strap therein to control the movement of the strap therethrough. The clamping mechanism of the sling clip is activated to define a predetermined length of strap between the muzzle end of the rifle and the sling clip when the rifle is in its firing position. In doing so, the sling clip will have effectively coupled the muzzle end of the rifle to the bearer's hips, thereby preventing or reducing upward movement of the muzzle end of the rifle caused by recoil of the rifle when the rifle is fired by transmitting the forces that cause the upward movement of the rifle muzzle through the strap to the hips of the bearer of the rifle.

The clamping mechanism for selectively clamping the strap to control the movement of the strap through the sling clip may comprise a locking mechanism that is coupled to a sliding block that is in turn slidably received on the legs of a U-shaped ring. The sliding block is moveable upon the legs of the U-shaped ring by the locking mechanism between an open position in which the strap of the sling moves freely and a closed position in which the sliding block clamps the strap of the sling between the U-shaped ring and the sliding block. Typically the locking mechanism will itself comprise an over-center lever mechanism.

DETAILED DESCRIPTION OF THE INVENTION

Figures 1, 4, 5, 6:
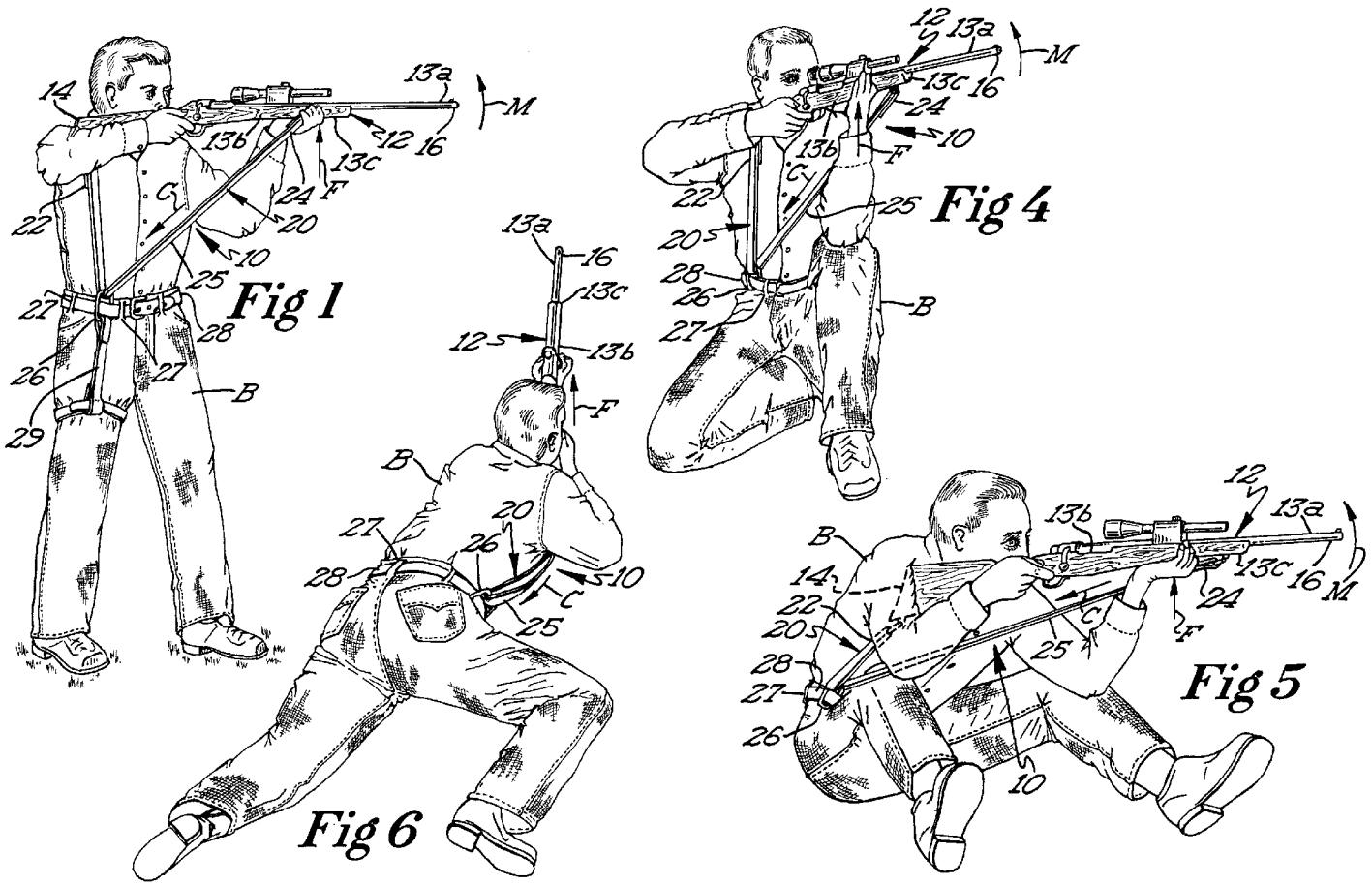
FIG. 1 illustrates a bearer of a rifle holding the weapon in a standing, offhand firing position, the rifle sling of the present invention being deployed in its firing position.
FIG. 4 illustrates a bearer of a rifle having a sling of the present invention coupled thereto, the bearer holding the rifle in a kneeling firing position.
FIG. 5 illustrates a bearer of a rifle having a sling of the present invention coupled thereto, the bearer holding the rifle in an open-legged sitting firing position; and, FIG. 6 illustrates a bearer of a rifle having a sling of the present invention coupled thereto, the bearer holding the rifle in the Olympic prone firing position.

FIG. 1 illustrates the rifle sling 10 of the present invention as it is employed with a firearm such as a rifle 12. The rifle 12 is of a known configuration, having a tubular barrel 13*a* mounted on a stock 13*b*. The stock 13*b* has a forward portion known as the forearm 13*c* that is generally positioned under the barrel 13*a* of the rifle 12 near the muzzle end 16 of the rifle. The forearm 13*c* of the rifle 12 may be separated from the remainder of the stock 13*b* or may be formed integral therewith. As can be seen, the bearer B of the rifle 12 has placed the rifle 12 in a firing position in which the butt end 14 of the rifle 12 is seated firmly into the shoulder of the bearer B with the rifle 12 held generally horizontal and supported by the bearer B at the forearm 13*c* near the muzzle end 16 of the rifle 12.

The sling 10 essentially comprises a strap 20 that is secured at a first end 22 to the butt end 14 of the rifle 12 and at a second end 24 to the muzzle end 16 of the rifle 12. See FIG. 2. Note that the exact manner in which the respective ends 22, 24 of the strap 20 are secured to the rifle 12 may vary, but preferably the strap 20 is secured at its ends 22, 24 to the rifle 12 by means of a swivel 23 of a type commonly known to the prior art for attaching rifle slings to a rifle 12. The strap 20 is fashioned of a flexible material such as leather or nylon webbing and may also include an adjustment mechanism for modifying the length of the strap (not shown). Such adjustment mechanisms are commonly known in the prior art.

The strap 20, along with any adjustment mechanisms and the mechanisms whereby the strap ends 22, 24 are secured to the rifle 12 are preferably inelastic. While the strap 20 must be flexible in order to facilitate firing and transportation of the rifle 12, it is important that once configured, the strap 20 maintains substantially the same length at all times. While it is appreciated that the preferred materials from which the strap are made, namely leather and nylon webbing, do incorporate some degree of flexibility, this inherent flexibility is within the requirements of the present invention. At the very least, it is important to minimize the degree of flexibility present within the strap 20 and therefore it may be preferable to utilize a substantially inelastic material such as Kevlar™, carbon fiber composites, or the like.

The portion 25 of the strap 20 intermediate the ends 22, 24 is passed through a sling clip 26. The sling clip is in turn coupled to the waist or truncal portions of the bearer B. In the simplest embodiment of the present invention as illustrated in FIG. 1, when a rifle 12 is to be fired, the butt 14 of the rifle will be firmly pressed into the shoulder of the bearer B. The placement of the butt end 14 of the rifle 12 in the shoulder essentially fixes the position of the first end 22 of the strap 20 with regard to the waist and truncal portions of the bearer B. The intermediate portion 25 of the strap 20 is similarly anchored to the waist and truncal portions of the bearer's body by means of the sling clip 26. The sling clip 26 may be as simple as a belt loop 27 on the bearer's B trousers or a carabiner of the type commonly used by climbers. More complex sling clips 26 may also be used. Note that the sling clip 26 may be coupled to the bearer's waist by means of a belt loop 27 or a belt 28. The belt 28 may be used on its own or may be combined with or may form part of a harness 29. Preferably, a harness 29 will further couple the sling clip 26 to the legs of the bearer B similar to the manner in which a typical climbing harness is secured to both the waist and legs of a climber.

The secure placement of the butt end 14 of the rifle 12 into the shoulder of the bearer B, along with the secure coupling of the intermediate portion 25 of the strap 20 to the waist of the bearer B effectively couples the muzzle end 16 of the rifle 12 to the waist and truncal portions of the bearer B. The application of a light to moderate upward force against the forearm 13*c* of the rifle by the forward hand of the bearer B, indicated by arrow F, serves to complete the coupling of the muzzle 16 of the rifle 12 to the truncal portions of the bearer b by creating of a relatively rigid structural member having a triangular shape with apexes at the first and second ends 22, 24 of the strap 20 and at the intermediate portion 25 of the strap 20 where it passes through the sling clip 26.

When the rifle 12 is fired, the recoil engendered by the firing tends to create a moment indicated by arrow M that is commonly referred to as muzzle flip. In rifles, shotguns, or other weapons constructed and arranged for a high rate of fire such as with semi-automatic and fully automatic weapons, the additive effect of multiple applications of the moment M can result in severe accuracy problems in that the muzzle end 16 of the rifle 12 will be jerked out of alignment with an intended target (not shown). The sling 10 of the present invention counteracts the moment M by applying a counteracting corrective force indicated by arrow C to the muzzle end 16 of the rifle 12 through the second end 24 of the strap 20. Because the rifle 12, the truncal portion of the bearer's body between the shoulder and the waist, and the strap 20 maintain essentially the same dimensions at all times during the firing of the rifle 12, the moment M engendered by the recoil in the rifle 12 will be counteracted by a tension in the strap 20 indicated by arrow C. Note that the rifle 12 may be fired in many different positions while using the sling 10 of the present invention. By way of example, and without limiting the application of the present invention in any way, a rifle 12 incorporating the present invention may be fired from an offhand standing position as seen in FIG. 1, from a kneeling position as seen in FIG. 4, from an open-legged position as seen in FIG. 5, and from the Olympic prone position as seen in FIG. 6. Note that sling 10 may be employed from virtually any firing position, including, but not limited to, standing positions, sitting positions, prone positions, kneeling positions, and bench rest positions.

Because the intermediate portion 25 of the strap 20 may freely pass through the sling clip 26 illustrated in FIG. 1, it is relatively simple to move the rifle 12 from its firing position illustrated in FIG. 1 to a slung position (not shown) in which the rifle is positioned over the right shoulder with the muzzle end 16 of the rifle 12 pointing upwards over the bearer's shoulder; the strap 20 passes over the shoulder to support the rifle 12. The rifle 12 may also be transported slung diagonally across the bearer's back, in the hand with the carrying arm extended, cradled in the crook of the bearer's right or left arm with the muzzle end 16 of the rifle 12 pointing upward, in a port arms or ready position, or cantilevered over the right or left forearm of the bearer B with the butt end 14 of the rifle 12 wedged beneath the corresponding right or left arm. Each of these transport positions for the rifle 12 may be achieved without first uncoupling the strap 20 from the waist and truncal regions of the bearer B.

Figures 2, 3:
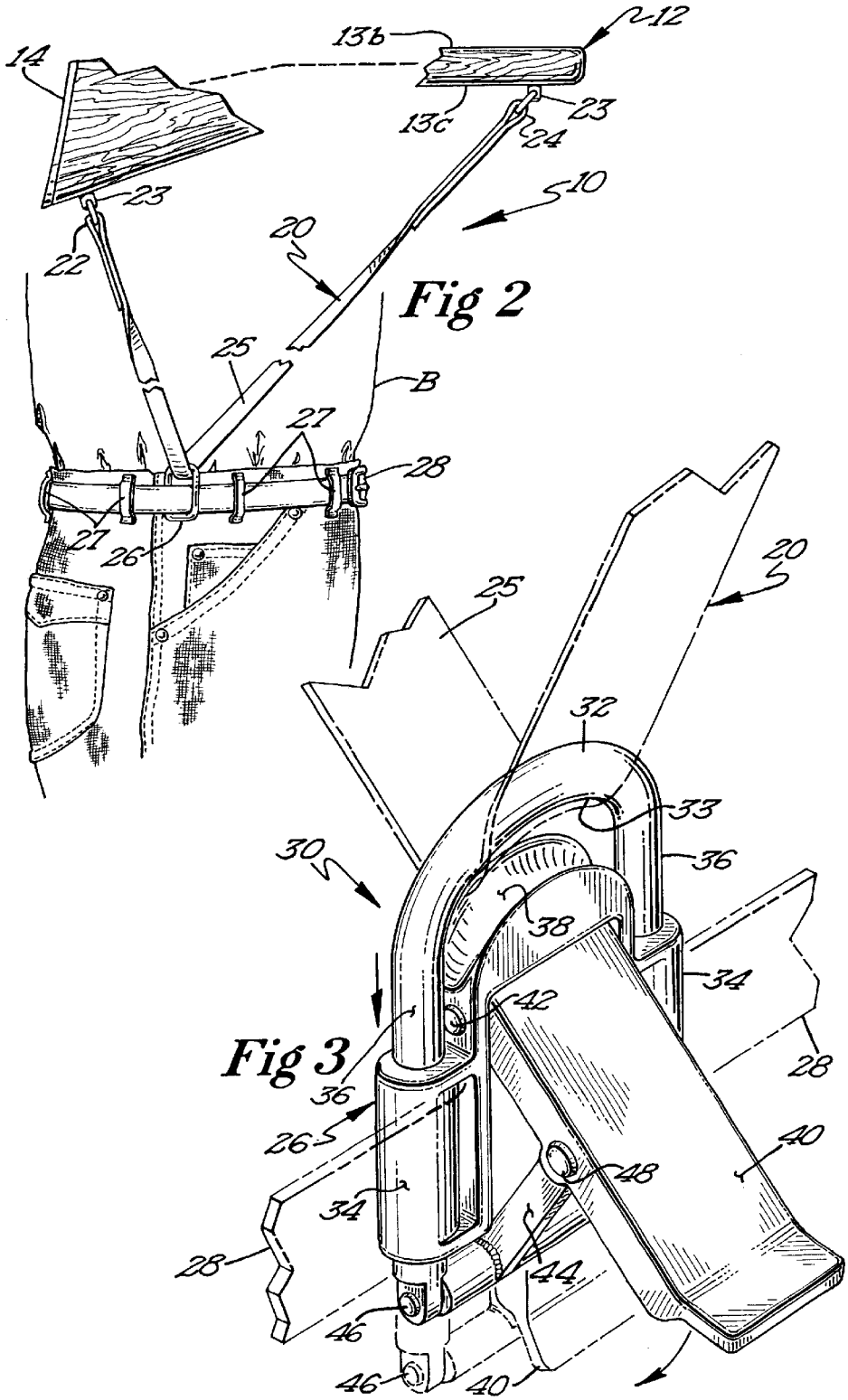
FIG. 2 is a close-up of an embodiment of the present invention comprising a simple carabiner coupled to a belt passed around the waist of the bearer.
FIG. 3 is a close-up of an embodiment of the present invention comprising a sling clip having a clamping mechanism.

A preferred embodiment of the present invention comprises a sling clip 26 that incorporates a locking mechanism 30. See FIG. 3. The sling clip 26 illustrated in FIG. 3 comprises a U-shaped ring 32 and a sliding block 34 received onto the parallel legs 36 of the ring 32. The sliding block 34 slides on the legs 36 between the open position shown in FIG. 3 and a closed position in which the upper, curved portion 38 of the sliding block engages the bottom 33 of the ring 32, consequently clamping the strap 20 therebetween and controlling the movement of the strap 20 through the sling clip 26. In FIG. 3 the strap 20 of the sling 10 is shown in phantom. The sliding block 34 is actuated between its open and closed positions by the locking mechanism 30. Locking mechanism 30 comprises a lever arm 40 that is rotatively pinned to the sliding block by pin 42. One or more fulcrum arms 44 are rotatively pinned to the distal ends of legs 36 of by pin 46. The fulcrum arms 44 are rotatively pinned at their opposing ends to an intermediate portion of the lever arm 40 by pins 48. When the lever arm 40 is moved from its open position to its closed position as shown in phantom in FIG. 3, the pinned end of the lever arm acts in conjunction with the fulcrum arms 44 to move the sliding block 34 to its closed position (not shown). The locking mechanism 30 may be operated by the bearer B by simply pressing down the lever arm 40 with the trigger hand when the rifle 12 is in its desired firing position. Preferably, the locking mechanism 30 will be constructed and arranged to remain in its closed position until such time as the bearer B physically opens or actuates the lever arm 40. This is easily accomplished by forming the lever arm 40 and the fulcrum arms 44 in an over-center arrangement. The sling clip 26 illustrated in FIG. 3 may be coupled to the hips of the bearer 26 by providing an attachment mechanism that may be coupled to a belt 28 or harness 29 that are themselves coupled to the bearer B.

The invention described above may be embodied in other forms without departing from the spirit or essential characteristics thereof. The embodiments disclosed in this application are to be considered in all respects as illustrative and not restrictive. The scope of the invention is indicated by the appended claims rather than by the foregoing description and all changes which come within the meaning and range of equivalency of the claims are intended to be embraced therein.

What is claimed is:

1. A rifle sling comprising a flexible strap having a first end and a second end, the first end of the strap being secured to the rifle near a muzzle end of the rifle, the second end of the strap being secured near a butt end of the rifle, and a sling clip that is secured to the hips of a bearer of the rifle, the strap being slidably received through the sling clip so that the bearer of the rifle may move the rifle from a slung position to a firing position without disconnecting the strap from the sling clip, the sling clip being further constructed and arranged such that when the rifle is in its firing position, the strap may be securely clamped within the sling clip to couple the muzzle end of the rifle to the hips of the bearer such that when the rifle is fired, the strap minimizes a rise in the muzzle end of the rifle caused by the recoil of the rifle as it is fired.

2. The rifle sling of claim 1 wherein the flexible strap and the sling clip are constructed and arranged to allow the bearer of the rifle to carry the rifle in the port arms position, cradled in the crook of the bearer's arm, to be slung over the shoulder of the bearer, to be slung across the bearer's back, and to be carried in the hand of the bearer with the bearer's arm extended, respectively.

3. The rifle sling of claim 1 wherein the strap is constructed and arranged to permit the rifle to be fired from a group of firing positions consisting of a prone position, a sitting position, a squatting position, an offhand position, a standing position, a kneeling position, and a rest position in which the rifle is supported, at least in part, by an object that is not the bearer of the rifle.

4. The rifle sling of claim 1 wherein the sling clip comprises a carabiner that may be looped around a belt of a bearer of a rifle and wherein the rifle sling further comprises a stop that limits the free travel of the strap through the carabiner of the sling clip when the rifle is in its firing position.

5. The rifle sling of claim 1 wherein the sling clip comprises a carabiner that is attached to one of a group consisting of a belt, a belt loop, and a harness, all of which are themselves coupled to the hips of a bearer of the rifle.

6. The rifle sling of claim 1 wherein the sling clip further comprises a clamping mechanism for selectively clamping the strap therein to control the movement of the strap through the sling clip and for defining a predetermined length of strap between the sling clip and the muzzle end of the rifle when the rifle is in its firing position.

7. A rifle sling for minimizing muzzle flip when the rifle is fired, the rifle sling comprising:

a strap having a first end and a second end, the first end of the strap connected to the rifle at a muzzle end of the rifle, the second end of the strap connected to the rifle at a butt end of the rifle, an intermediate portion of the strap between the first and second ends thereof being passed through a sling clip that is secured to the hips of the bearer of the rifle, the sling clip further comprising a clamping mechanism that may selectively clamp the strap therein to control the movement of the strap therethrough, the clamping mechanism of the sling clip being activated to define a predetermined length of strap between the muzzle end of the rifle and the sling clip when the rifle is in its firing position, upward movement of the muzzle end of the rifle caused by recoil of the rifle when the rifle is fired being transmitted through the strap to the hips of the bearer of the rifle so as to limit the vertical movement of the muzzle end of the rifle during firing.

8. The rifle sling of claim 7 wherein the sling clip comprises a carabiner and the clamping mechanism comprises a stop that is affixed to the strap to control the travel of the strap through the carabiner, the stop being located upon the strap so as to define a predetermined distance between the muzzle end of the rifle and the sling clip.

9. A rifle and sling, the rifle having a barrel mounted in a stock, the stock having a butt end arranged to be positioned against the shoulder of a bearer when the rifle is in a firing position, the stock of the rifle also having a forearm portion positioned adjacent a muzzle end of the barrel, the muzzle end of the rifle being supported at the forearm portion of the stock by the bearer when the rifle is in its firing position, the rifle being steadied in its firing position by a sling comprising a strap having a first end and a second end, the first end of the strap being rotatively attached to the rifle adjacent its butt end and the second end of the strap being rotatively attached to the rifle at the forearm portion of the stock of the rifle adjacent the muzzle end of the barrel of the rifle, the strap further having an intermediate portion that is coupled to the waist of the bearer such that when the butt end of the rifle is positioned against the bearer's shoulder, the strap will pass downward to the bearer's waist and from there to the forearm portion of the stock of the rifle so as to prevent recoil forces engendered in the rifle as a result of firing the rifle from causing to the muzzle end of the rifle to raise up, the strap of the rifle being further capable of supporting the rifle in a carrying position in which the rifle is positioned on the back of the bearer for transport.

10. The rifle and sling of claim 9 wherein the strap of the sling is coupled to the waist of the bearer using a carabiner mechanism that is itself coupled to one of a belt and a harness that is worn about the waist of the bearer.

11. The rifle and sling of claim 10 wherein relative motion of the strap with respect to the sling is controlled by a stop attached to the strap of the sling such that when the rifle is in its firing position, that portion of the strap between the first end of the strap and the stop couple the muzzle end of the rifle to the waist of the bearer of the rifle.

12. The rifle and sling of claim 9 wherein relative motion of the strap with respect to the sling is controlled by passing the intermediate portion of the strap through a sling clip coupled to the waist of the bearer that is constructed and arranged to releasably grip the strap of the sling when the rifle is in its firing position, thereby directly coupling the muzzle end of the rifle to the waist of the bearer when the rifle is in its firing position.

13. The rifle and sling of claim 9 wherein the strap of the sling is substantially non-elastic.

14. The rifle and sling of claim 13 wherein the strap of the sling is fashioned from one of a webbing material and leather.

15. The rifle and sling of claim 9 wherein the strap of the sling is coupled to the waist of the bearer by one of a belt passed around the waist of the bearer and a harness that is coupled to at least one thigh of the bearer.

16. The rifle and sling of claim 9 wherein relative motion of the strap with respect to the sling is controlled by passing the intermediate portion of the strap through a sling clip coupled to the waist of the bearer that is constructed and arranged to releasably grip the strap of the sling when the rifle is in its firing position, thereby directly coupling the muzzle end of the rifle to the waist of the bearer when the rifle is in its firing position, the sling clip comprising a locking mechanism coupled to a sliding block that is slidably received on the legs of a U-shaped ring, the sliding block being moveable by the locking mechanism between an open position in which the strap of the sling may move freely through the U-shaped ring and a closed position in which the sliding block clamps the strap of the sling between the U-shaped ring and the sliding block.

17. The rifle and sling of claim 16 wherein the locking mechanism of the sling clip is an over-center lever mechanism.

* * * * *